US005782278A

United States Patent [19]

Larsson

[11] Patent Number: 5,782,278

[45] Date of Patent: Jul. 21, 1998

[54] CANT FORMING DEVICE

[75] Inventor: Kenneth Larsson, Mockfjard, Sweden

[73] Assignee: Disk Knife System i Sverige AB, Mockfjard, Sweden

[21] Appl. No.: 665,235

[22] Filed: Jun. 17, 1996

[51] Int. Cl.[6] ..... B27C 9/00

[52] U.S. Cl. ..... 144/220; 144/176; 144/241; 144/373; 144/235; 241/292.1

[58] Field of Search ..... 241/92, 93, 292.1; 144/39, 41, 162.1, 176, 218, 220, 223, 235, 240, 241, 373

[56] References Cited

U.S. PATENT DOCUMENTS

| | | | |
|---|---|---|---|
| 2,964,079 | 12/1960 | Johnson | 144/235 |
| 3,304,970 | 2/1967 | Altosaar | 144/176 |
| 3,461,931 | 8/1969 | Wexell | 144/220 |
| 4,161,972 | 7/1979 | Hanaya | 144/176 |
| 4,184,526 | 1/1980 | Hanaya | 144/176 |
| 4,266,584 | 5/1981 | Lomnicki | 144/220 |
| 4,456,045 | 6/1984 | Gregoire | 144/220 |

FOREIGN PATENT DOCUMENTS

| | | |
|---|---|---|
| 9100345 | 2/1991 | Sweden . |
| 9100346 | 2/1991 | Sweden . |
| 9304091 | 12/1993 | Sweden . |

*Primary Examiner*—W. Donald Bray
*Attorney, Agent, or Firm*—Larson & Taylor

[57] ABSTRACT

The invention is meant for a cant forming arrangement of the kind with at least two rotational chipping heads with a basic cut off conical form where they each have a basic conical main surface and a small end, whereby the chipping heads are arranged in pairs with the small ends turned opposing one another and equipped with replaceable knives which are arranged on the respective chipping head's main face with the purpose to surface a log on two opposing sides, through length feeding of a log between the chipping heads, while they are rotating, and that the wood which is removed is made directly to chips by the knives. A single knife in at least one spiral set of cutting knives closest to the chipping head's small end, shows a main angled cutting edge which, besides that it in a known way extends substantially parallel with a rotational plane to the chipping heads, is angled 10 to 50 degrees back in relation to a radius through the rotation center and the chipping heads, in such a way that an outer, from the rotational center furthest away end of the main cutting edge is located further back towards the rotational direction in relation to an inner, closer to the rotational center located end of the cutting edge.

12 Claims, 8 Drawing Sheets

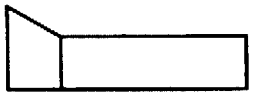
FIG. 10
PRIOR ART
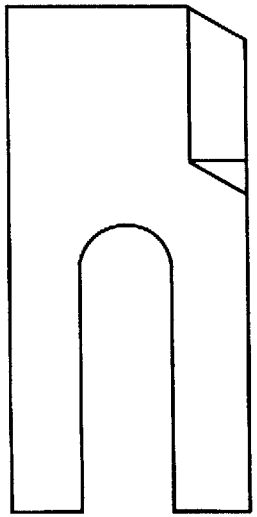
FIG. 13
PRIOR ART
FIG. 14
PRIOR ART
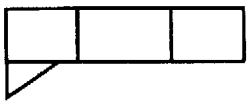
FIG. 15
PRIOR ART
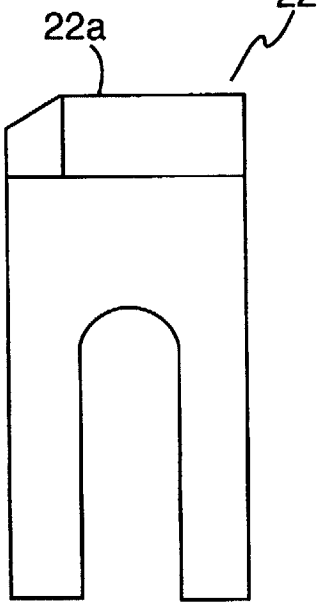
FIG. 12
PRIOR ART
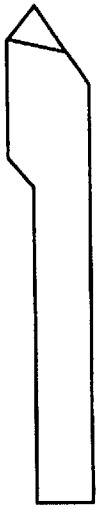
FIG. 11
PRIOR ART

CANT FORMING DEVICE

FIELD OF THE INVENTION

This invention relates to a cant forming device that includes at least two opposed rotating knife holders, also known as chipping heads, where each chipping head is generally in the shape of a truncated cone. The chipping heads may be arranged in pairs with the vertices of the cones in opposed facing relation. The opposed facing surfaces of the chipping heads have releasably secured knives on the opposed facing exposed surfaces of the chipping heads. Lengthwise feeding of a log between rotating chipping heads cuts opposed parallel planar faces into the log to form a cant. The wood that is cut from the log to form the cant is directly turned into reusable wood chips by the knives.

BACKGROUND OF THE INVENTION

Cant forming arrangements or so called Cant Reducers, with or without saw blades, have been developed to turn a round log into a cant with at least two opposite, flat and parallel surfaces. The removed wood is made into marketable chips. Advantageously, a minimum amount of pinchips, sawdust and fines are generated. In order for the chips to be used as, for example, raw material in the production of pulp, the chips have to have a well defined size and shape. For this reason it is preferred to keep the pinchips, sawdust and fines generated to a minimum. The presence of sawdust, overthick chips and pinchips, if not screened out, may result in a reduced sale price for the chips.

The surface that is generated on the cant by the chip producing knives is generally too coarse and is often corrected by a facing saw or other means. This re-surfacing can be done by a finishing disc knife, or by a saw blade which is mounted in the vertex of the conical chipping heads. It is preferred that resurfacing of the cant is done with knives so as to produce the best wood chips while keeping the overthick chips, pinchips, sawdust and fines to a minimum.

It is a known problem with earlier known cant forming arrangements that the knives have the tendency to cause tear-outs with relatively deep scars and damage to the cant surface and overthick wood chips as a result. This problem is most visible in conjunction with knots and twisted grain fibre in the wood, whereby a chunk of a knot or a part of the twisted grain fibres can be pulled out by the knives. Correcting for such tear-outs results in planing of the surface to a greater depth than would otherwise be required, with increased planer shavings generated.

One way to eliminate the problem of tear-outs is to equip each knife with a pre-cutting saw blade, in other words, a saw blade which has a diameter which is larger than leading edge of the knife. This pre-cuts a groove in the log prior to the knives cutting the remainder of the wood (which will be removed as chips). However, the sawdust generated by this method is substantial, as the saw blade has, for structural strength reasons, a certain minimum thickness. The thickness is normally 4–6 mm. In other words, there will always be a 4–6 mm thick section of wood next to each cant surface that will be turned into sawdust, regardless of wood species, wood quality, knots, etc. An example of this type of chipping head is the subject of U.S. Pat. No. 4,266,584 which issued to Lomnicki on May 12, 1981.

If the depth of the sawdust forming fine surface can be generally reduced by about 2 mm when cutting a cant, it would in a sawmill which processes about 100,000 cubic metres of logs in one year mean an increase in wood chip production of approximately 24,000 cubic metres (loose volume) per year. As the price for sawdust only is approximately 15% of the price for wood chips, this would mean a considerable added value to the sawmills products. Thus it is an object of the invention to keep the sawdust producing surface cleaning to no more than 1–2 mm by use of the improved knife of the present invention to reduce the amount of required surface cleaning by a sawblade on a cant.

It is a further object of the present invention to provide a chipping head knife having compound angled main cutting edges thereby providing a chipping head knife that will cut softer and easier through a log, and, further, that by substituting such knives for all or many of the knives on the chipping heads, will result in a reduction in energy consumption during operation, smoother travel, reduced noise level, and improved cant surfacing and chip recovery.

It is an object of this invention to produce a cant forming arrangement whereby the chip forming knives give an improved finished surface. It is also an object to have the knives create a flat and smooth surface so that a minimum of knot tear-out is generated and so that pinchips, sawdust and fines can be reduced or eliminated without the use of a pre-cutting saw blade.

The invention is therefore built on applicant's knowledge that the problem of knot and grain tear-outs on a cant, to a large degree, depend on the knives' cutting angle in relation to the wood fibre direction. This is especially the case for the knife or knives which are positioned closest to the conical formed knife top or small end which is removing the chips closest to the cant surface.

In the prior art, knives have placed one main knife edge oriented basically parallel with a radial line through the knife and the chipping head axis of rotation. Because the feed plane for the logs that are fed through a cant forming arrangement are located a certain distance below the chipping heads' axis of rotation, the lower part of the cant surface is cut by a knife edge having a positive cutting angle in relation to the wood fibre. This means that the radially outermost end of the knife cuts the wood fibres before the radially inner end of the knife. The knife will therefore act on the wood in the lower cant area with a cutting force which is directed forward, ie. in the logs' feed direction, in other words, parallel with the fibre grain direction. Therefore the risk is great that individual fibres instead of being cut off, will be torn off the cant.

The case of the cutting knives acting on the cant with a cutting force which is directed forward in the cants' feed direction has, with earlier known cant-forming arrangements, been used for length feeding of the cant. For this reason a separate feed arrangement has not been needed. In some cases the main knife has been mounted somewhat back-angled in relation to the radial line through the axis of rotation of the chipping heads and the knives. This back-angle has only been around 5 degrees and was designed only in order to reduce the forward pulling force and leave the feed speed at the rotational speed of the knife with the purpose of improving the cant's surface finish.

The problem with tear-outs has been especially noticeable in the cant's lower edge, where in previously known cant forming arrangements, the furthest end of the knife edge from it's rotational center has left the wood, ie. been rotated out of contact with the cant. Thus, it is a further object of the present invention that the knife edge shall be positioned in relation to the radial line so that the end of the knife closest to the axis of rotation will leave the wood before, or at least at the same time, as the radially outermost end of the knife.

The main cutting edge angle in relation to the radial line is in this case dependent on the distance between the feed plane for the logs or cants and the axis of rotation of the chipping heads rotational center, and the distance between the axis of rotation and the radially closest knife.

In order to form chips with well defined form and size it is advantageous that, in addition to the main knife edge which cuts the wood parallel to the fibre direction, a secondary edge be provided which cuts the wood in a direction against the fibre. Such a knife that has a main edge and a secondary edge used in combination, will have a main edge preferably formed along a flat formed part of the knife, with the secondary edge being formed along a ridge on one side. However, it is within the scope of the present invention to provide a main knife edge and secondary edge formed on separate knives, which are shown on SE467915 (from application no. 9100345-9) to Larsson.

The cutting knives of the present invention may be mounted in one or more, normally three, spiral formed passages along the face of the chipping head. This type of chipping head is generally referred to as a spiral chipping head. It is normally sufficient however that the knife in each spiral situated closest to the small end of the chipping head is a knife having compound angled main edge according to the present invention. There is nothing however that prevents additional cutting knives of the present invention to be used in each spiral.

In the marketplace there are other types of chipping heads, i.e. step chipping heads and long wing knife chipping heads. With these types of chipping heads the cutting edges are not placed parallel with a rotational face of the knife holder, and thus will not cut the wood parallel to the cant surface but cut the wood fibres at an angle against the cant. However, it is within the scope of the present invention to utilize this type of cant forming arrangement, and that one or more knives can be arranged in accordance with the invention in the area closest to the small end of the chipping head (ie., towards the center) to improve the cant's surface smoothness.

The invention provides other advantages which will be made clear in the summary of the invention and description of the preferred embodiments.

SUMMARY OF THE INVENTION

The cant forming device of the present invention has an opposed facing pair of chipping heads for rotation in a direction of rotation about an axis of rotation, each chipping head having a truncated conical shape, a small end of the conical shape in closest spaced apart relation to a corresponding small end on the chipping head in opposed facing relation, have releasably mountable cutting knives mountable on a surface thereon to plane opposed parallel planar surfaces on a workpiece being fed longitudinally between the chipping heads, whereby wood is removed from the workpiece in the form of wood chips, wherein at least one cutting knife in at least one spiralled radially spaced apart array of cutting knives on the surface comprises a main cutting edge extending in a first plane substantially parallel with a rotational plane of the chipping heads, wherein the main cutting edge is angled back in relation to a rotational radius through the axis of rotation of the chipping heads rotational center and at least one cutting knife, and wherein the main cutting edge has a first end furthest away from the axis of rotation and a second end located closer to the axis of rotation and the first end is spaced from the rotational radius in a direction reverse to the direction of rotation.

Advantageously, the main cutting edge is linear and forms a first cutting angle relative to the radius, the angle diverging from the second end to the first end relative to the radius. In one aspect the main cutting edge is angled at an angle of 10 to 50 degrees back in relation to the rotational radius. In a further aspect, the main cutting edge is angled at a first angle 15 to 40 degrees back in relation to the rotational radius. In yet a further aspect the main cutting edge is angled at a first angle 20 to 30 degrees back in relation to the rotational radius.

In the present invention the main cutting edge is so angled in relation to the rotational radius, that the end of the main cutting edge closest to the rotational center leaves the cant before, or at least at the same time as the end of the main cutting edge furthest from the rotational center.

Advantageously the cutting knife of the present invention has a secondary cutting edge contiguous to and extending from the first end of the main cutting edge wherein the secondary cutting edge is angled at a second angle out of the first plane and away from the log, whereby wood fibre cut from the log by the main cutting edge is subsequently cut off to form wood chips by the rotation of the cutting knife in the first plane about the rotational center into cutting engagement with the log. In one aspect of the present invention the second angle is approximately 35 degrees. In a further aspect, the secondary cutting edge is generally linear. In yet a further aspect, the secondary cutting edge and the main cutting edge are generally in a second plane and the second plane is generally perpendicular to the first plane and is angled back in relation to the rotational radius in a direction reverse to the direction of rotation.

BRIEF DESCRIPTION OF THE DRAWINGS

The invention will be better understood by reference to drawings, wherein:

FIGS. 10–15 are six enlarged views of a conventional prior art cutting knife used in common chipping heads;

DETAILED DESCRIPTION OF THE PREFERRED EMBODIMENT

Figure 1:
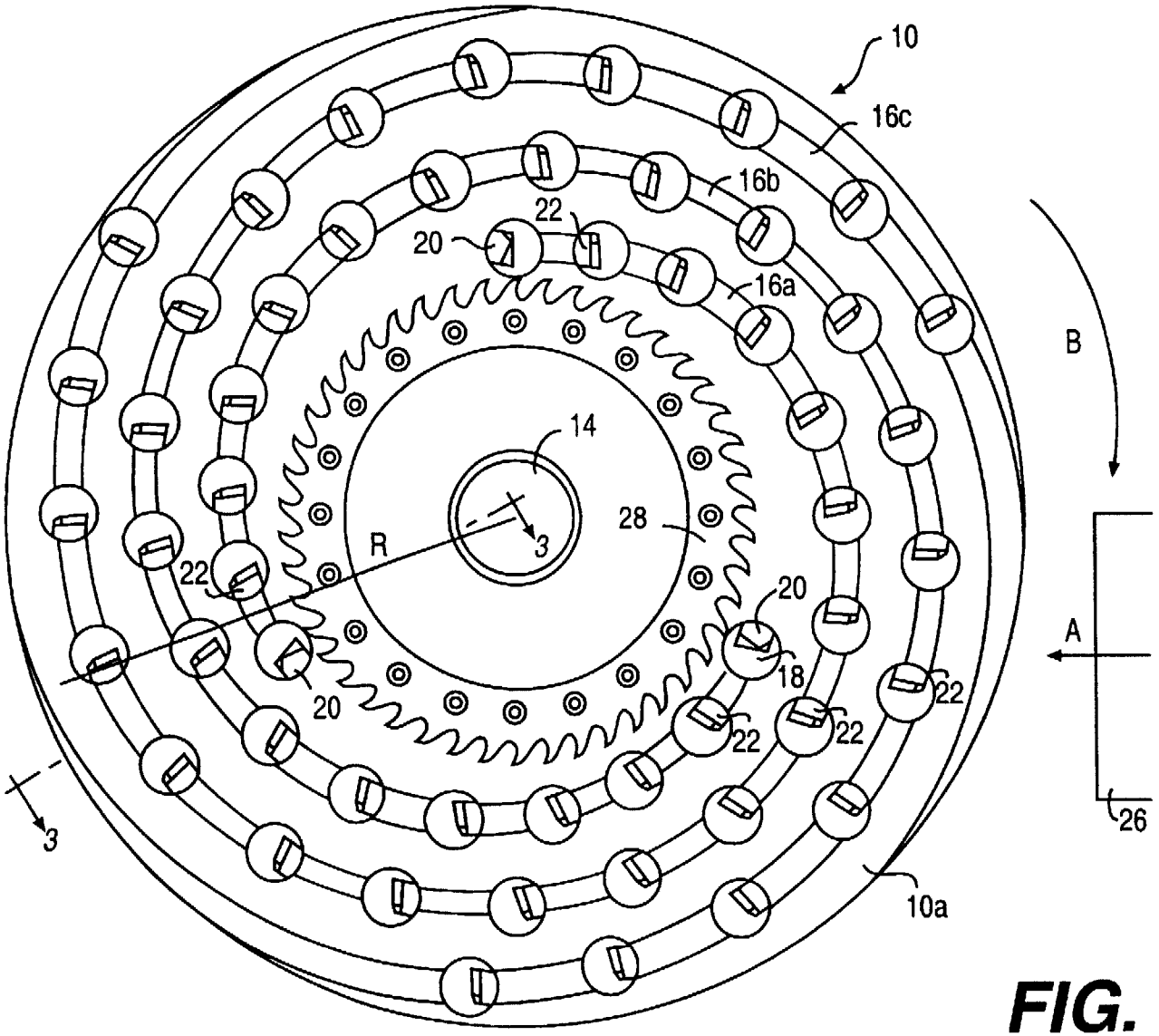
FIG. 1 is a front elevation view of a chipping head made according to a preferred embodiment of the invention, showing the cutting knives in a spiral arrangement, generally being a view along line 1—1 in FIG. 3.
Figure 2:
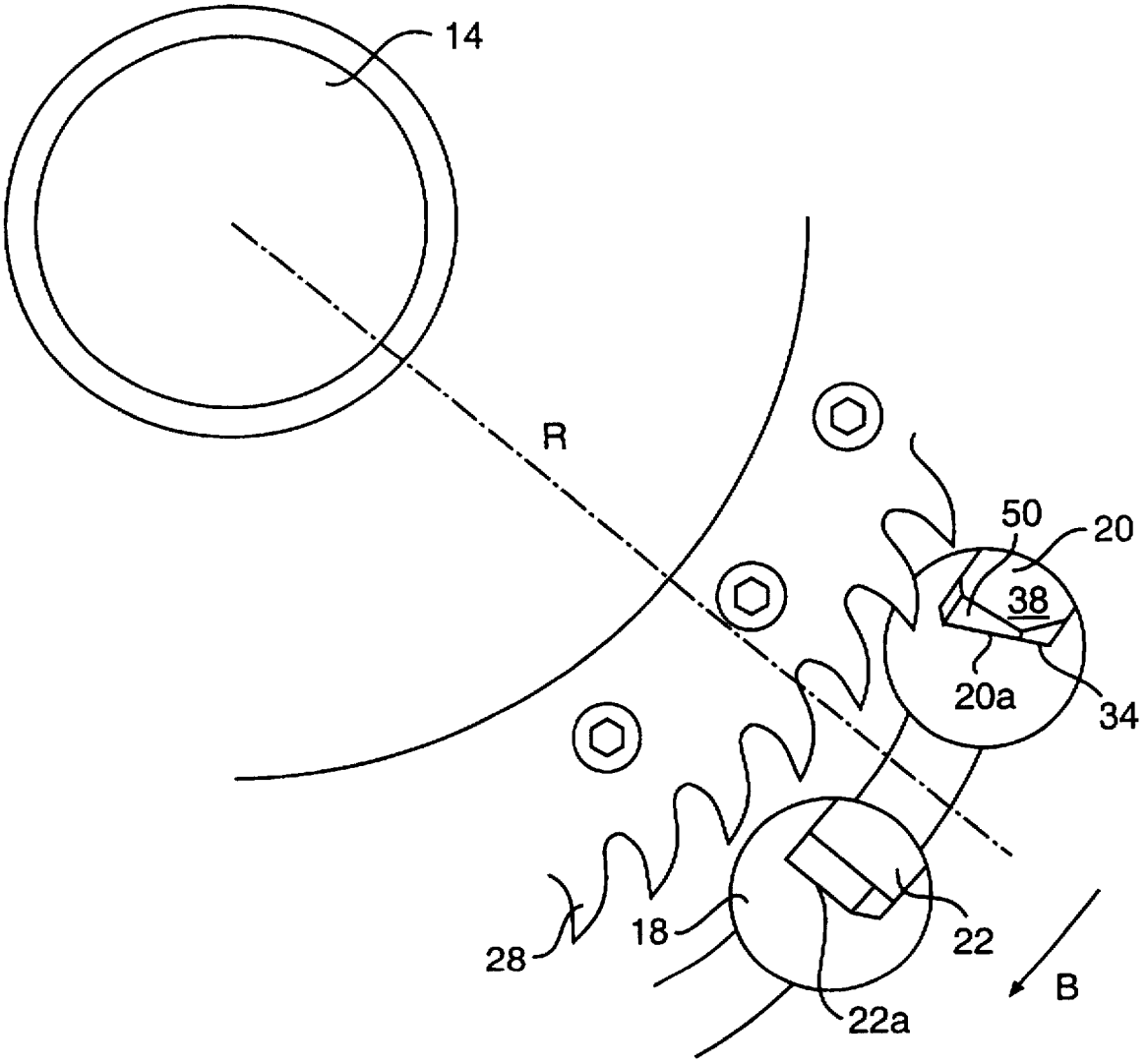
FIG. 2 is an enlarged fragmentary view of the knife according to FIG. 1 showing first and second cutting knives in the spiral arrangement.
Figure 3:
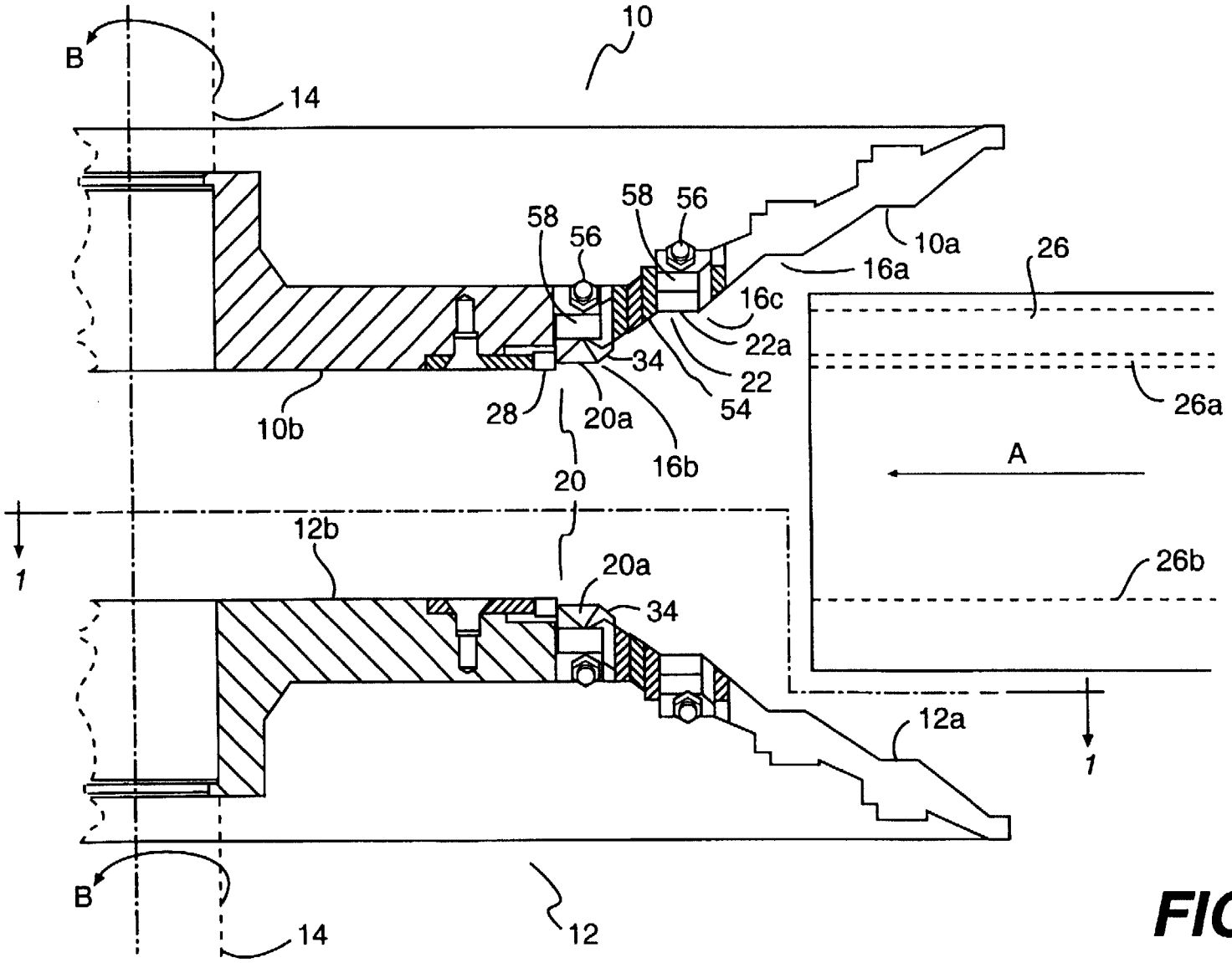
FIG. 3 is a cross-sectional view taken along line 3—3 in FIG. 1 including a mirror image cross-sectional view of an opposed facing chipping head.
Figure 4:
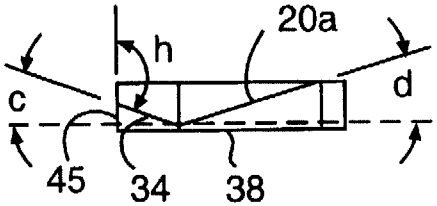
FIGS. 4–9 are six enlarged views of the cutting knife according to the preferred embodiment of the invention.
Figure 7:
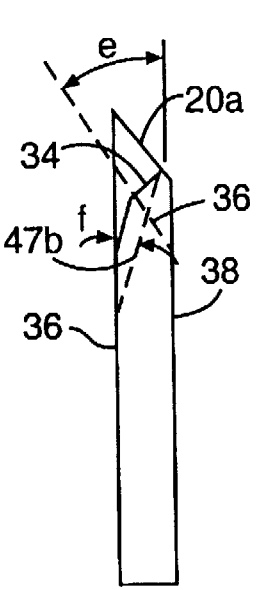
Figure 8:
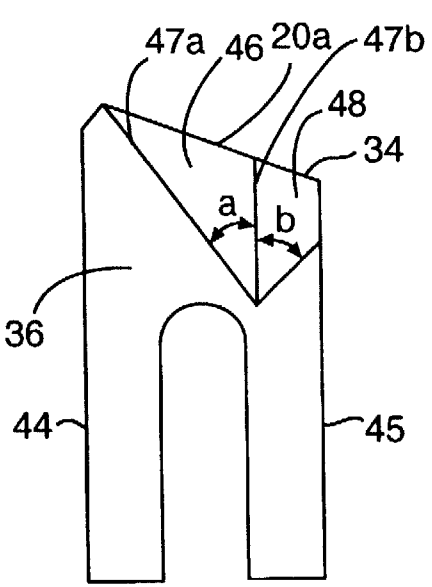
Figure 9:
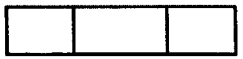
Figure 6:
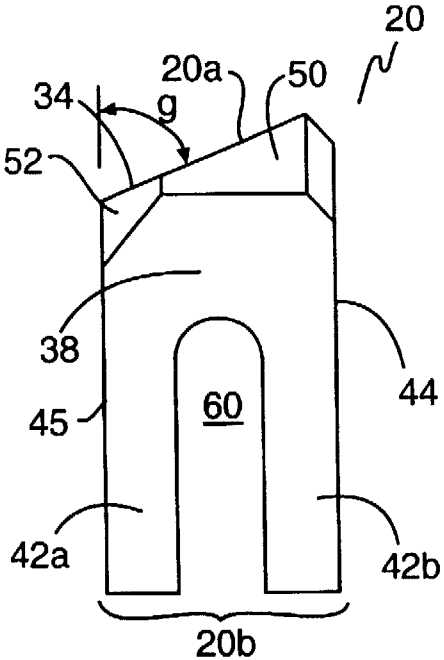
Figure 5:
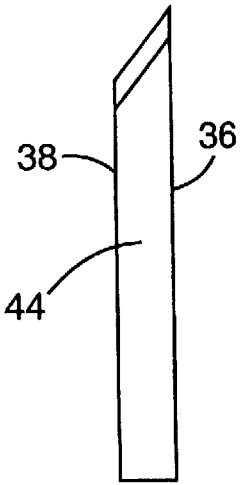

In FIGS. 1 and 2 a front elevation view is shown of chipping head 10 in the form of a so-called spiral chipping head. FIG. 3 shows, in partial cross section, a cant forming arrangement incorporating opposed facing chipping heads 10 and 12 in the opposing arrangement of two typical spiral chipping heads. The chipping head 10 is mounted on drive shaft 14.

Spiral chipping heads 10 and 12 are mirror images of each other, generally in the shape of truncated cones in spaced apart opposed facing relation. The chipping heads may be formed to include three spiral curves 16a, 16b, and 16c in their surfaces, although more spirals may be used. As seen in FIG. 3, the spiral curves form steps (spiralling outwards from the center of rotation of the chipping heads) which are generally parallel to a plane of rotation of the chipping heads 10 and 12. Along each spiral curve 16a, 16b, and 16c are, in radially spaced array, circular holes 18 in the surfaces 10a and 12a of chipping heads 10 and 12. In holes 18 are bolted with knives 20 and 22 using bolts 56 such as depicted in FIG. 3.

During operation, chipping heads 10 and 12 both rotate in direction B so as to bring first knives 20 and second knives 22 into cutting engagement with a log or cant 26 moving in direction A. A log or a cant 26 which is fed between chipping heads 10 and 12 will thereby be worked by first knives 20 and second knives 22 resulting in two opposed facing planed cant surfaces 26a and 26b (shown in dotted outline). For finishing of the cant 26 surfaces each chipping head 10 and 12 may have a saw blade or saw-toothed ring 28 at finishing ends 10b and 12b respectively, finishing ends 10b and 12b corresponding to the narrow or small ends of the truncated cones.

As best seen in FIGS. 10–15, labelled "prior art", second knives 22 are of conventional type. Main cutting edge 22a extends substantially parallel with the plane of rotation of spiral chipping heads 10 and 12. Main edge 22a lies generally on a radial line R extending radially from the axis of rotation of drive shaft 14 and chipping heads 10 and 12. As seen in FIGS. 4–9, first knife 20 differs in at least one aspect from second knife 22 in that angled edge 20a, which also lies generally parallel to the plane of rotation of chipping heads 10 and 12, is angled away from radius line R along a line diverging in a direction reverse to direction B from radius line R. As the radial distance along radius line R increases, angled edge 20a diverges at, in the preferred embodiment, between 25 to 30 degrees, from radius line R. The angle of edge 20a in relation to radius line R may be between 10 to 50 degrees, preferably between 15 to 40 degrees and in a preferred embodiment between 25 to 30 degrees. The angle of edge 20a can be varied within wide ranges depending on the species of the wood, the number and size of wood knots, log dimensions, etc. Typically an angle of between 25 to 30 degrees seems to be approximately optimum, although this may be affected by the direction of the wood fibre in the workpiece, ie., in log 26.

Each knife 20 also has an angled secondary edge 34 adjacent angled edge 20a. The radially outermost, ie., outermost along radial line R, comer of angled edge 20a abuts adjacent angled secondary edge 34. As best seen in FIG. 3, angled edges 20a extend generally parallel to the plane of rotation of chipping heads 10 and 12 to cut the wood of log 26 in a direction generally parallel to the fibre direction of log 26, although it is understood that the fibre direction will often not be as depicted in the illustrations. To accomplish this, each knife 20 is seated on an angled mounting plate or seat (not shown) on the chipping heads so as to maintain edges 20a in parallel planar relation to the plane of rotation of the chipping heads. The secondary edges 34 on the other hand are angled in relation to the plane of rotation of the chipping heads so as to be angled away from the center line of log 26, ie. towards the widest part of the truncated cones of the chipping heads. They extend radially outwards from angled edges 20a along radius line R. The secondary edges 34 cuts the wood of log 26 at an angle in relation to the fibre direction. The plane of rotation of the chipping heads is of course a plane perpendicular to the axes of rotation of drive shafts 14.

Knife 20 may be releasably mounted on conventional chipping heads 10, 12 in the manner of conventional chipping head knives by means of cut-out 60. Knife 20 is flat formed with a front side 36 and a backside 38. Shanks 42a and 42b are formed by cut out 60 in lower end 20b, where knife 22 is best seen in FIGS. 10–15. Edges 20a and 34 are formed by grinding knife 20. Knife 20 is ground on front side 36 to form surfaces 46 and 48, which form angles "a" and "b" relative to their line of intersection (see FIG. 8), and angles "c" and "d" relative to a plane parallel to backside 38 and intersecting the line of intersection between surfaces 46 and 48. Angle "a" is an approximate 35 degree angle. Angle "b" is approximately 45 degrees. Angle "c" is approximately 20 degrees. Angle "d" is approximately 15 degrees. Backside 38 is ground to form surfaces 50 and 52. The line of intersection between surface 50 and backside 38 forms a line generally at right angles relative to edge 44. The edge of surface 52 adjacent edge 45 forms angle "e" relative to the plane containing back side 38. Angle "e" is approximately 30 degrees.

The side of knife 20 opposite ground angled surfaces 52 form an approximate 40 degrees angle against the backside 38. The break angle between the main surface 46 and the front side 36 along break line 47a extends approximately 40 degrees relative to side edge 45. The break angle between the main surface 50 and the front 38 extends with an angle of approximately 90 degrees relative to side edges 45 and 44. The break angle between the surfaces 46 and 48 along break line 47b forms angle "f". Angle "f" may be approximately 20 degrees. Thus a knife may be constructed in which main edge 20a may be angled about 60 to 65 degrees (angle "g") relative to side edge 45, and secondary edge 34 may be angled approximately 10 degrees (angle "h") relative to side edge 45. Knife 20 is meant to be mounted so that the surfaces 46 and 48, during operation, act as cutting surfaces while the surfaces 50 and 52 provide relief surfaces. Knife 20 is advantageously arranged so that the main surface 50 has a relief angle of about 2 to 3 degrees in relation to the chipping head's rotational plane.

The advantages of knife 20 are many. For example, it is possible to mount knife 20 in the same kind of holder 54 which is used for conventional knives without having to modify the chipping heads. This allows any number of knives 20 to be used to replace conventional knives 22 in spirals 16a, 16b and 16c as desired. The mounting of the knives are done as shown in FIG. 3 with a bolt 56 and chip breaker 58, whereby the bolts 56 are journalled in cut out 60, and the knives secured by clamping the knife between a surface of the holder 54 and the chip breaker 58. Re-sharpening of the knife 20 with the angled main edge 20a is done in the same way as with a conventional knife through plane grinding of surfaces 50 and 52. This means that no special arrangements need to be undertaken when grinding and this can be done at the same time as the conventional knives are ground. The result is an angled main edge 20a without having the working width reduced as compared to conventional knives. Angled main edge 20a may be formed by rotating a conventional knife, accomplished by the twisting of the holder 54, but this causes a reduced working width of the knife. Further, the position of the knife changes and thus requires a complete rebuild of the chipping head.

ALTERNATE EMBODIMENTS OF THE INVENTION

It is understood that the invention can be modified in many ways without departing from the scope of the invention. For example, the invention is not limited to using such specially made knives 20 exactly as set out above, or to having knives 20 positioned closest to the chipping head's center 10*b* and 12*b* (small end of the chipping heads). As an example, it may be that all the knives in a chipping head are knives 20.

Figure 16:
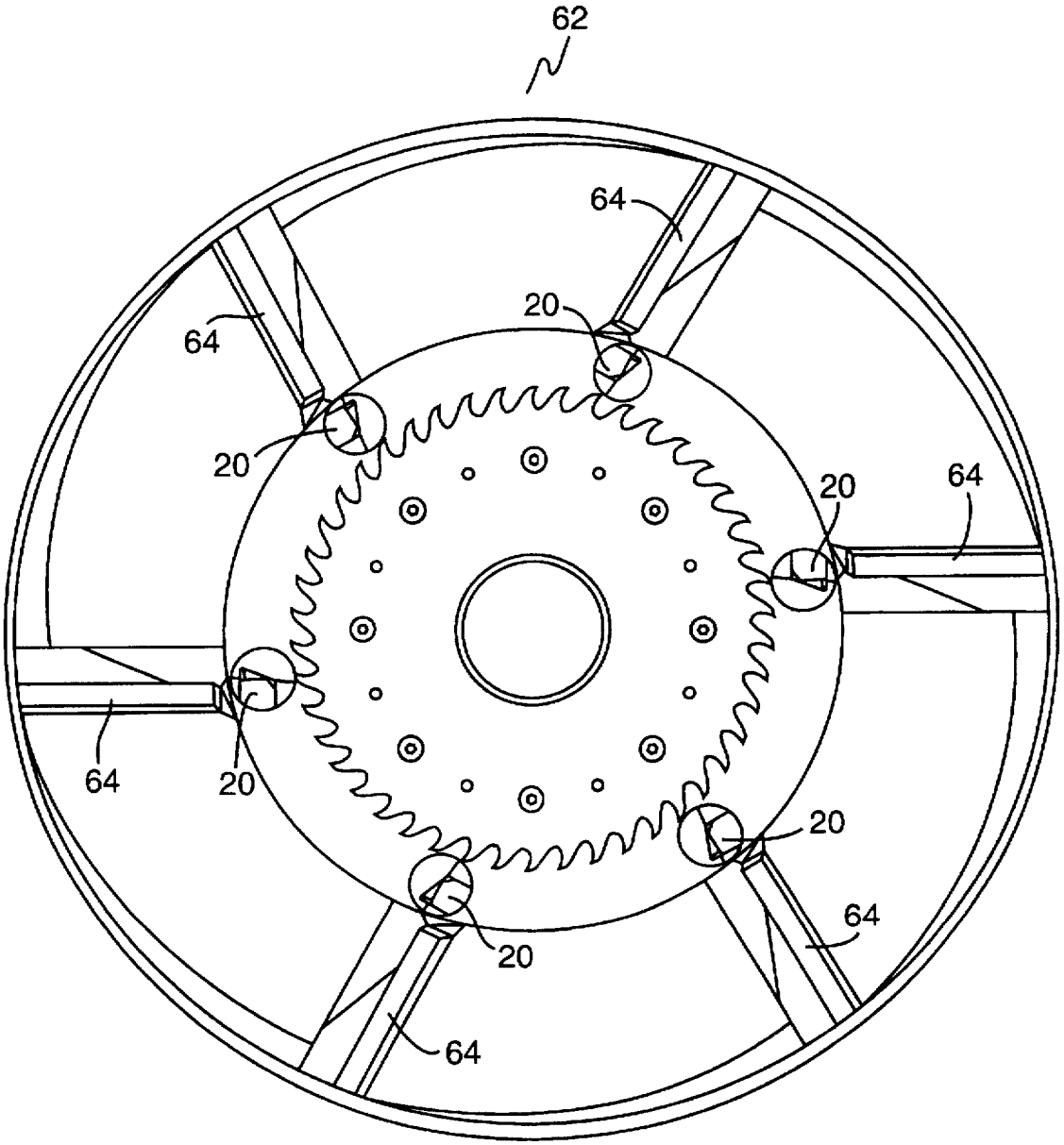
FIG. 16 is a front elevation view of an alternative embodiment chipping head according to the present invention integrated with a known wing knife type chipping head.
Figure 17:
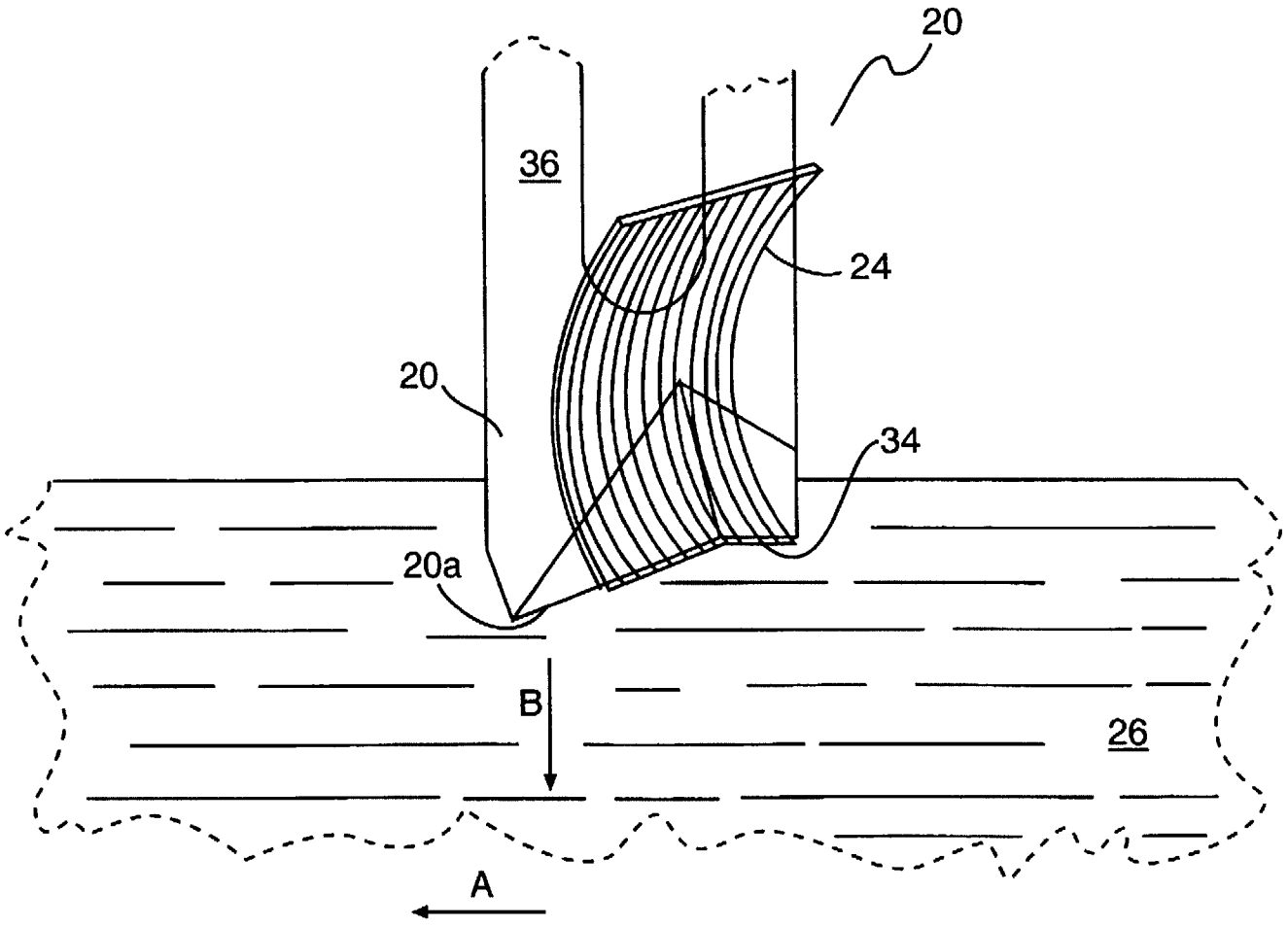
FIG. 17 is in side elevation view, the cutting knife of FIGS. 4–9 in cutting engagement with a cant.

Further, as seen in FIG. 16, the knives of the present invention may be incorporated into a differently formed chipping head 62 which uses conventional wing knives 64 mounted in angled relation to a radius through the rotational axis.

Figure 18:
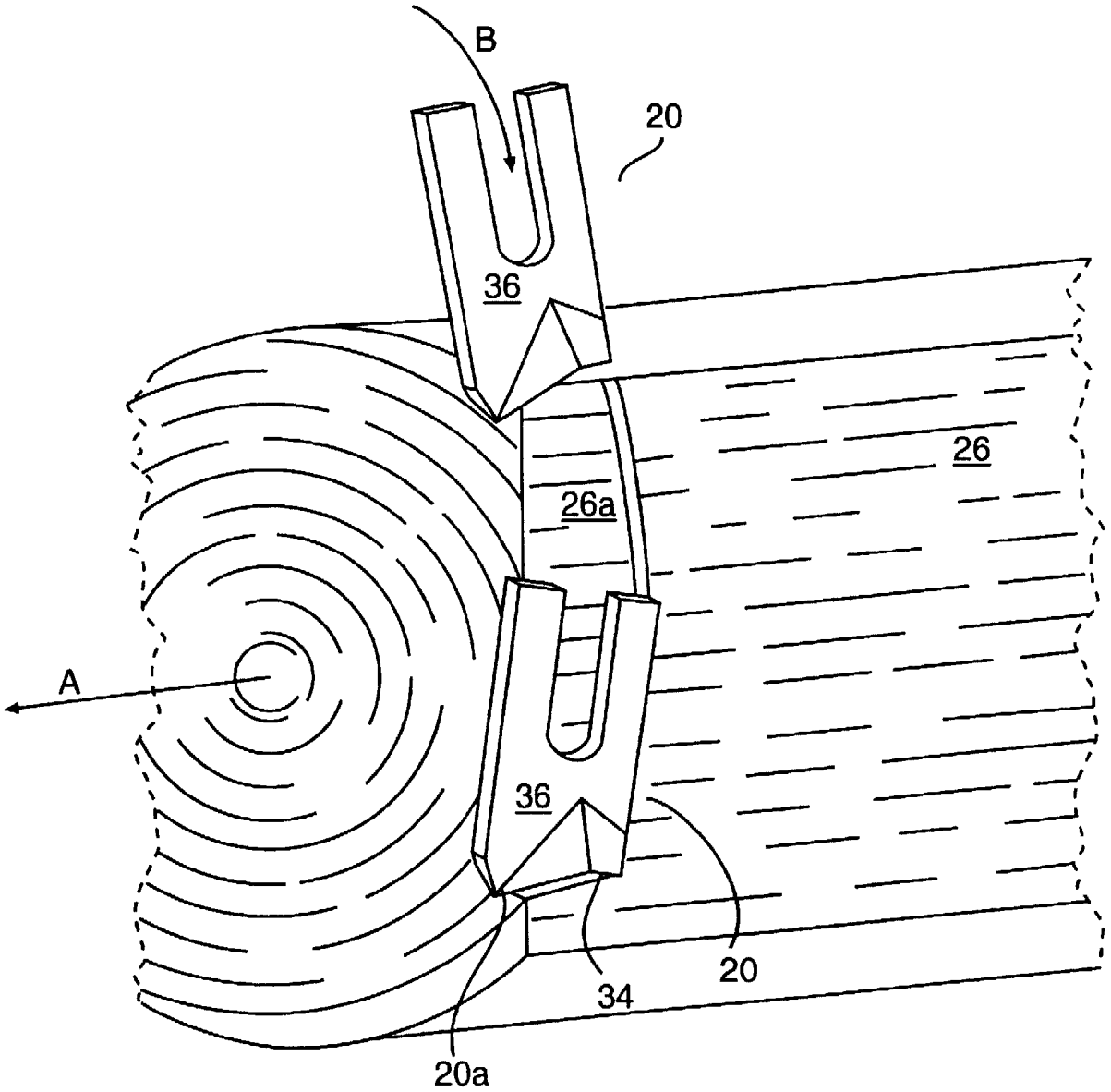
FIG. 18 is, in perspective view, cutting knives of FIGS. 4–9 in cutting engagement with a cant.

As a rule the rotating cutting knives main edges are used as a directional force to feed the logs through the cant reducer. This is done through the conventionally formed and mounted cutting knives, with the main edges substantially parallel with a radius R through the rotation axis, at least in the cant's lower part, which affect the cant with a force applied in the direction of feed. As illustrated in FIG. 18 (wherein the chipping head and wood chips 24 are omitted for clarity), the knife 20 of the present invention differs in that the main knife edge 20*a* when exiting the cant 26 from the cant's lower part, is generally parallel to the wood fibres 27 rather than the radius R and as such does not have a force directed in the direction of the feed. Feeding must thus be accomplished by a separate feed means, or through successively reduced angling of the main knife edges in the direction out towards the chipping heads periphery As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. In a cant forming device having an opposed facing pair of chipping heads for rotation in a direction of rotation about an axis of rotation, each chipping head having a truncated conical shape, a small end of said conical shape in closest spaced apart relation to a corresponding small end of said chipping head in opposed facing relation, wherein each of said chipping heads have releasably mountable cutting knives mountable on a surface thereon to plane opposed parallel planar surfaces on a workpiece being fed longitudinally between said chipping heads, whereby wood is removed from said workpiece in the form of wood chips, at least one cutting knife mountable in at least one radially spaced apart array of cutting knives on said surface comprises a main cutting edge extending substantially across said at least one cutting knife, said main cutting edge extending in a first plane substantially parallel with a rotational plane of said clipping heads, wherein said main cutting edge is angled back in relation to a rotational radius, in said first plane through said axis of rotation of said chipping heads rotational center and said at least one cutting knife, and wherein said main cutting edge has a first end furthest away from said axis of rotation and a second end located closer to said axis of rotation and said first end is spaced from said rotational radius in a direction reverse to said direction of rotation.

2. The cant forming device according to claim 1 wherein said main cutting edge is linear and forms a first cutting angle relative to said radius, said angle diverging from said second end to said first end relative to said rotational radius.

3. The cant forming device according to claim 1, wherein said main cutting edge first is angled at an angle of 10 to 50 degrees back in relation to said rotational radius.

4. The cant forming device according to claim 1, wherein said main cutting edge is angled at a first angle 15 to 40 degrees back in relation to said rotational radius.

5. The cant forming device according to claim 1, wherein said main cutting edge is angled at a first angle 20 to 30 degrees back in relation to said rotational radius.

6. The cant forming device according to claim 1 wherein said main cutting edge is so angled in relation to the rotational radius, that the end of the main cutting edge closest to the rotational center leaves the cant before, or at least at the same time as the end of the main cutting edge furthest from the rotational center.

7. The cant forming device of claim 1 wherein said cutting knife further comprises a secondary cutting edge contiguous to and extending from said first end of said main cutting edge wherein said secondary cutting edge is angled at a second angle out of said first plane and away from said log, whereby wood fibre cut from said log by said main cutting edge is subsequently cut off to form wood chips by the rotation of said cutting knife in said first plane about said rotational center into cutting engagement with said log.

8. The cant forming device of claim 7 wherein said second angle is approximately 35 degrees.

9. The cant forming device of claim 7 wherein said secondary cutting edge is generally linear.

10. The cant forming device of claim 7 wherein said secondary cutting edge and said main cutting edge lie generally in a second plane and said second plane is generally perpendicular to said first plane and is angled back in relation to said rotational radius in a direction reverse to said direction of rotation.

11. The cant forming device of claim 1 wherein at least one radially spaced apart array of cutting knives is at least one spiralled radially spaced apart array of cutting knives.

12. The cant forming device according to claim 1 wherein said at least one radially spaced apart array of cutting knives is at least one concentric radially spaced apart array of cutting knives.

* * * * *